United States Patent [19]

Cavanaugh et al.

[11] Patent Number: 4,516,725

[45] Date of Patent: May 14, 1985

[54] DUAL COMPONENT PUMPING SYSTEM

[75] Inventors: James E. Cavanaugh; Robert D. Hetherington, both of Sunland; Thomas A. Parmley, Downey, all of Calif.

[73] Assignee: 501 Binks Manufacturing Co., Franklin Park, Ill.

[21] Appl. No.: 432,081

[22] Filed: Sep. 30, 1982

[51] Int. Cl.[3] ..... B05B 7/24

[52] U.S. Cl. ..... 239/127; 239/305

[58] Field of Search ..... 239/99, 124, 127, 305, 239/569, 570, 574, 337; 222/135, 318

[56] References Cited

U.S. PATENT DOCUMENTS

| | | | |
|---|---|---|---|
| 3,202,363 | 8/1965 | Kaute et al. | 239/570 X |
| 3,765,605 | 10/1973 | Gusmer et al. | 239/61 |
| 3,790,030 | 2/1974 | Ives | 222/135 |
| 3,894,690 | 7/1975 | Hill | 222/135 X |
| 4,312,463 | 1/1982 | Daby | 222/135 X |
| 4,337,282 | 6/1982 | Springer | 239/305 X |

*Primary Examiner*—Andres Kashnikow

*Attorney, Agent, or Firm*—David O'Reilly

[57] ABSTRACT

A dual component pumping system comprised of a double-acting air motor alternately driving reciprocal pumps. Mechanically operated pilot valves activate a spool valve which reverses the air motor operation. Each pump has an inlet connected to a separate fluid component supply tank and an outlet connected to a spray gun through flexible hoses. A valve switching arrangement permits switching from one fluid to the other. The valve switching allows spraying of a fluid received from one pump while the other pump is in a bypass mode and recirculates fluid from its supply tank.

8 Claims, 3 Drawing Figures

DUAL COMPONENT PUMPING SYSTEM

FIELD OF THE INVENTION

This invention relates to fluid pumping systems and more particularly relates to a fluid pumping system having dual reciprocal pumps for selectively delivering dual fluid components.

BACKGROUND OF THE INVENTION

A pump for pumping high viscosity fluids is disclosed and described in U.S. patent application Ser. No. 346,529, filed Feb. 8, 1982, now abandoned. The present system is an improved system using a pump of the type disclosed in this application. Generally the pump disclosed in the above-identified application is designed for pumping a high viscosity fluid through alternate reciprocal pumps operated by a double-acting air motor. In this pumping system, the inputs and outputs are connected together through manifolds to supply a high viscous fluid continuously through the alternating reciprocal pumps. Thus, while one pump is taking fluid in, the other pump is supplying fluid to a spray gun or the like through the manifold.

It would be advantageous if each pump could be used independently to pump a separate fluid. This would permit selection of one or the other of two fluid components for delivery through a spray gun.

It is therefore one object of the present invention to provide a dual pumping system having means for selecting one of two fluid components.

Still another object of the present invention is to provide a dual pumping system having a pair of alternating reciprocal pumps of different capacity for pumping different viscosity fluids.

Still another object of the present invention is to provide a dual pumping system for pumping different volumes of fluid.

Yet another object of the present invention is to provide a dual pumping system in which one fluid can be pumped while another fluid is being recirculated.

BRIEF DESCRIPTION OF THE INVENTION

The purpose of the present invention is to provide a pump which can selectively pump one or the other of two fluid components of different viscosity or at different volumetric flow rates.

These purposes are accomplished by a double acting motor which alternately drives reciprocal pumps. Each pump has a separate intake tube for drawing fluid from separate supplies. A switching system permits selection of one pump to deliver fluid while fluid passing through the other pump is recirculated. Each pump outlet may be connected to deliver fluid to a spray gun, accessory, appliance or any other outlet. If the outlets of both pumps are connected to a single appliance, a switching system is provided to select the pump being used.

The motor is preferably a double acting air motor but could be any type of double acting motor drive system. The motor drives reciprocal pumps which may be the same or different sizes. That is, the pumps could have different output to input ratios (i.e. different displacements). With different pumps, fluids having different viscosity and flow rates can be pumped. Thus, the pumps could selectively pump different viscosity fluids at the same rate or similar viscosity fluids at different flow rates. The invention thus provides a simple, easy method of selectively pumping one of two fluids for a variety of purposes. The fluids might be two different paints (i.e. different colors, consistency, etc.) or two completely different fluids, such as a thin catalyst and a heavy gel coat.

The above and other objects and features of the invention will be more fully understood from the following detailed description and the accompanying drawings in which:

DESCRIPTION OF THE PREFERRED EMBODIMENT

Figure 1:
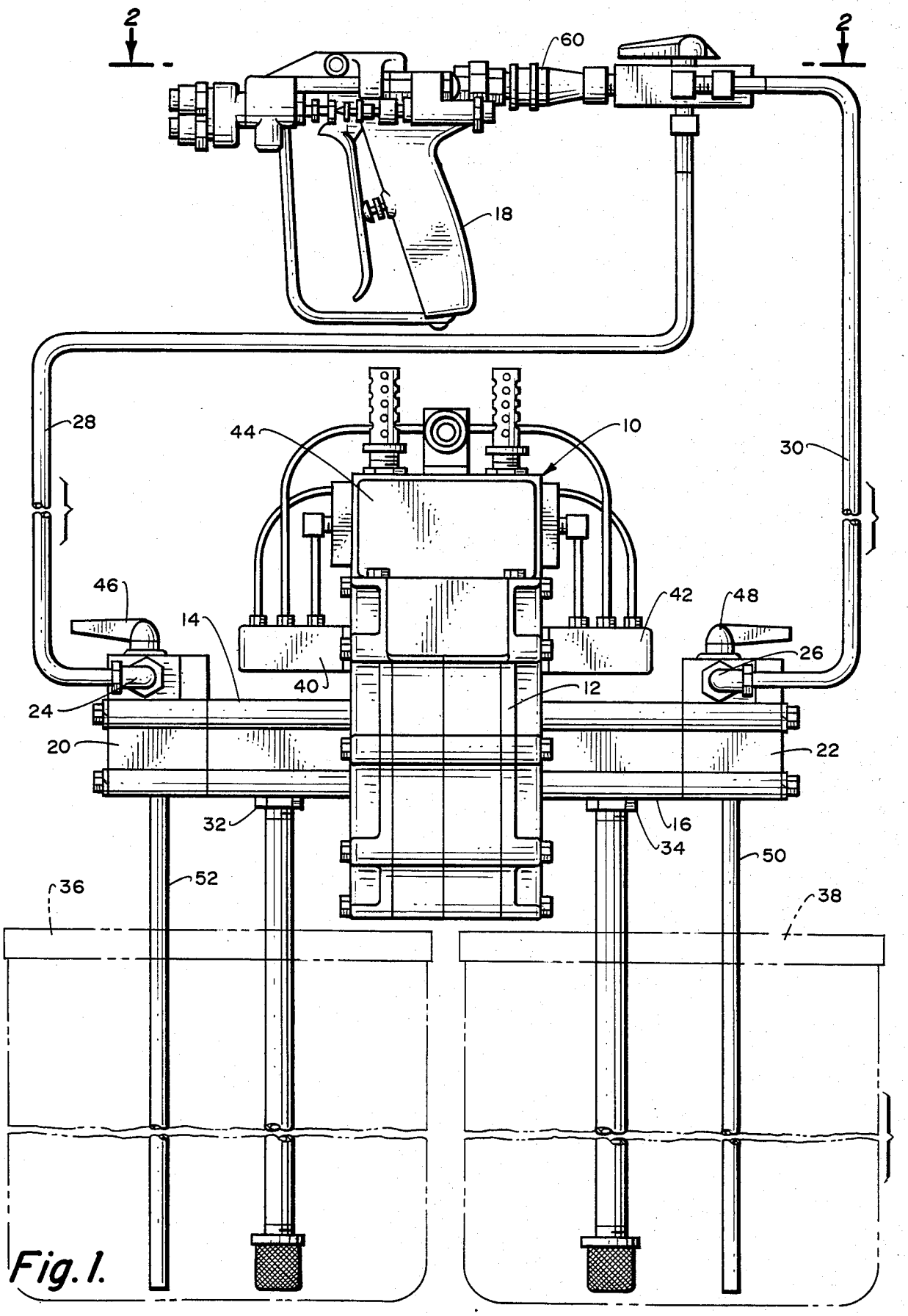
FIG. 1 is a side elevation of a dual component pumping system constructed according to the invention.
Figure 2:
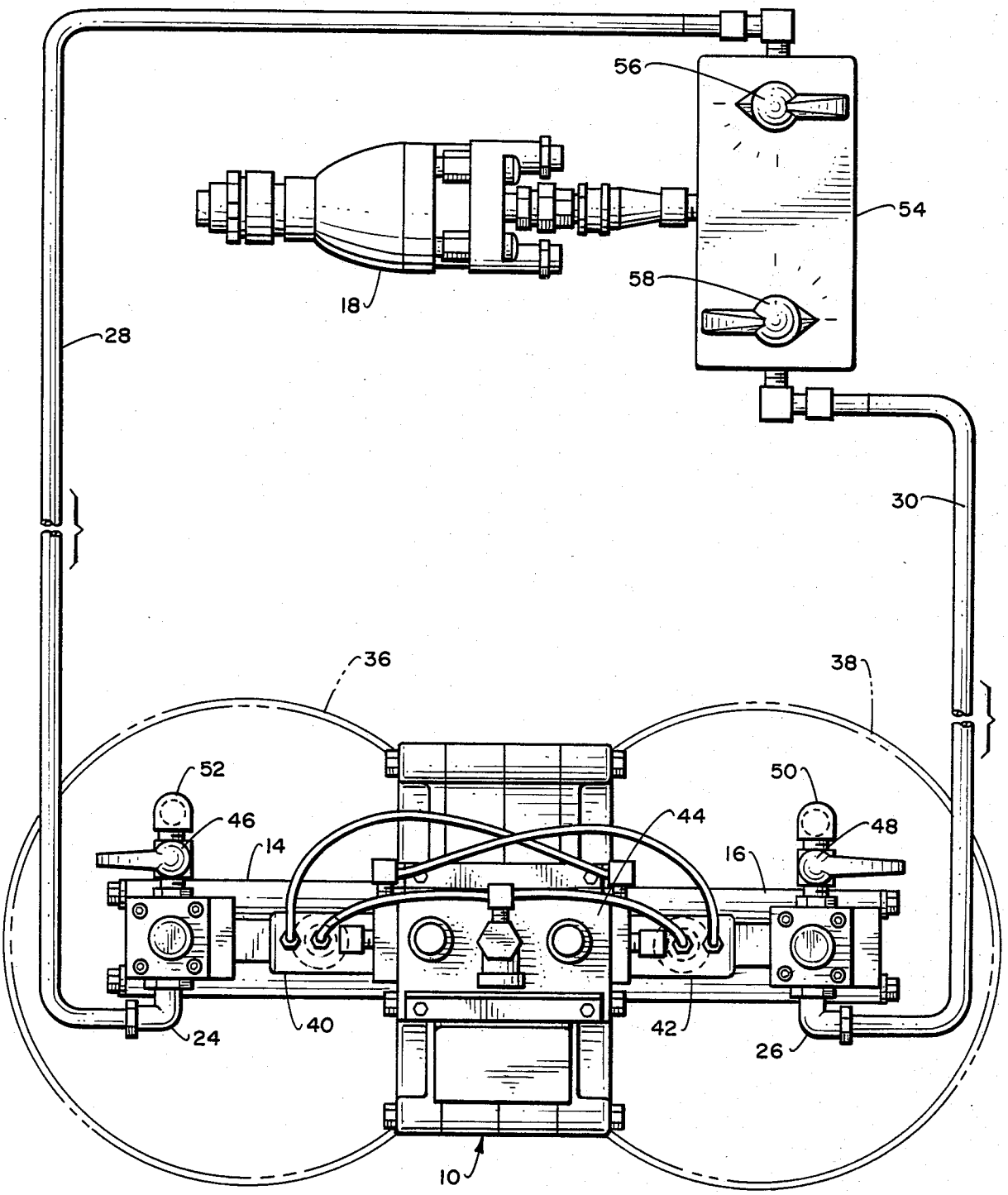
FIG. 2 is a top view of the pumping system according to FIG. 1.

The dual component pumping system is shown generally in FIG. 1 and is comprised of pump 10 similar to that disclosed and described in U.S. patent application Ser. No. 346,529, filed Feb. 8, 1982, incorporated herein by reference. The pump is comprised of an air motor 12 driving reciprocal pumps 14 and 16 for delivering fluid components to a typical spray gun 18. The components may be any type of fluid for spray through a typical paint or fluid component spray gun 18. Each pump 14 and 16 has a pumping chamber 20 and 22 for delivering separate fluid components through outlets 24 and 26 to hoses 28 and 30 connected to spray gun 18. Pumps 14 and 16 have intakes 32 and 34 receiving fluid components through intake or dip tubes 33 and 35 from supply tanks 36 and 38 shown in phantom for illustration purposes only.

Fluid is drawn through dip tubes 33 and 35 from tanks 36 and 38 into the pumps for delivery to hoses 28 or 30 respectively. Each pump is alternately reciprocated by air motor 12 whose operation is reversed by pilot valves 40 and 42 operating spool valve 44. Flow control valves 46 and 48 permit selection of one or the other of fluids from tanks 36 and 38 for delivery to spray gun 18 or other accessories, appliances or outlets. For example, with valve 46 open, fluid from tank 36 will be delivered through intake 32, pump 14 to outlet 24. At the same time, valve 48 is closed and fluid in tank 38 will flow through intake 34, pump 16 back to the tank through bypass pipe 50. To switch from the fluid in tank 36 to the fluid in tank 38, valve 46 is closed and valve 48 opened. The fluid in tank 36 will then flow through pump 14 back to tank 36 through bypass pipe 52. In this manner, the operator may select either the fluid in tank 36 or the fluid in tank 38.

An additional control is provided by means of a valve control block 54 having control valves 56 and 58. This valve control block 54 prevents fluid remaining in hoses 28 and 30 from being drawn into the spray gun 18. With valves 46 and 56 in the open position, fluid from tank 36 is delivered through conduit 28 to spray gun 18. To switch to the fluid in tank 38, which may be any viscous fluid or a different color fluid such as a different paint, valves 46 and 56 are closed and valves 48 and 58 are opened. Fluid in tank 36 will now be recirculated through pump 14 and bypass pipe 52 back to the tank. An advantage of this is that the recirculated fluid is kept constantly mixed for instant use. The fluid in 38 will then be delivered to pipe 30 through valve 58 to the spray gun 18. Thus, with the dual reciprocal pumps shown, selection and switching from the fluid in 36 to the fluid in 38 is simple and easy by simply turning two valves.

Figure 3:
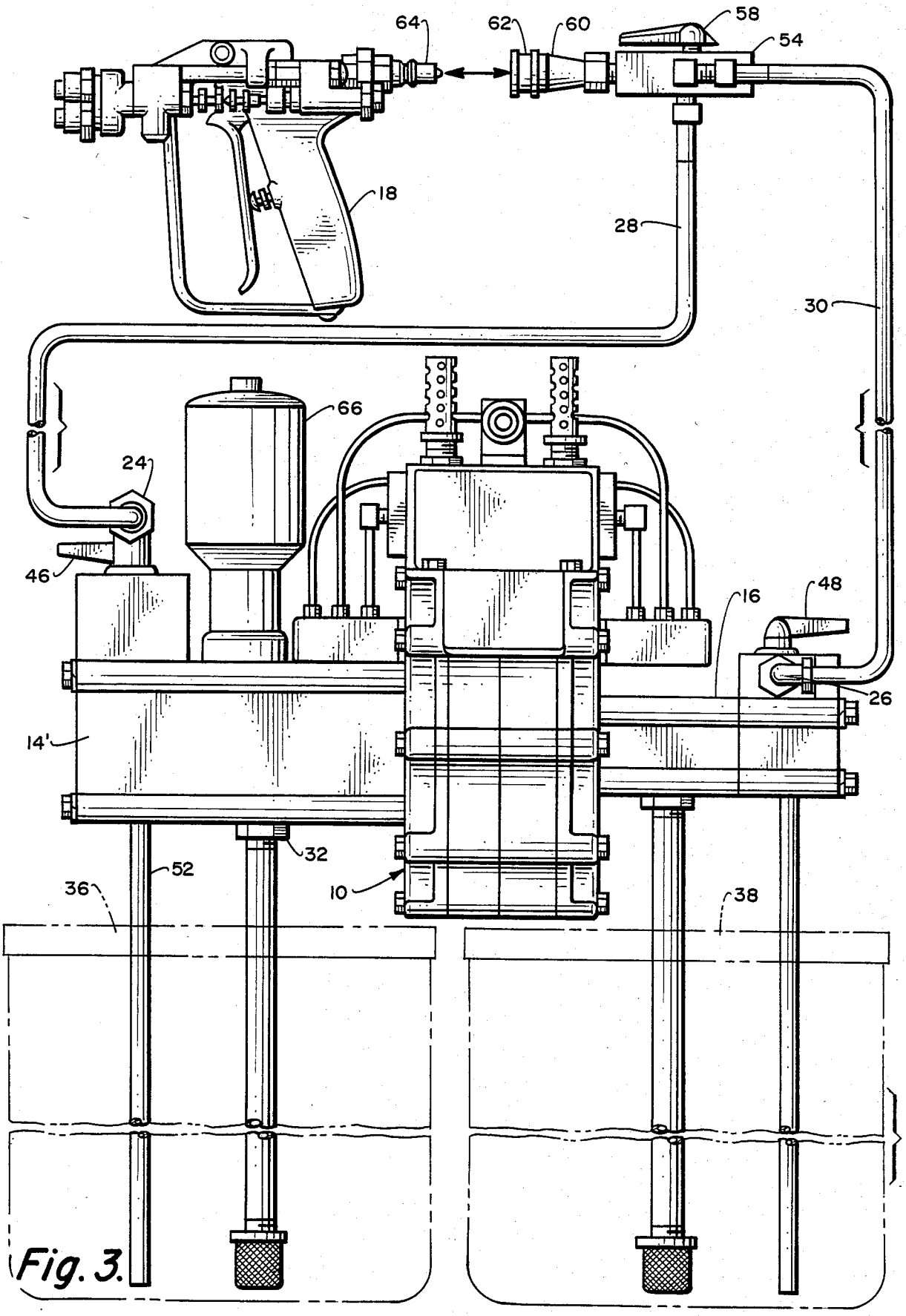
FIG. 3 is a side elevation illustrating an alternate construction of the pumping system of FIG. 1.

If the fluids in tanks 36 and 38 are of a different viscosity or perhaps a larger supply were desired from one tank than the other, then the pumps 14 and 16 could be of unequal capacity as shown in the embodiment of FIG. 3. In this embodiment, pump 14' can have an output ratio of 2, 4 or more times the output of pump 16. Thus, pump 14' which has a filter 66 could deliver a heavier viscosity fluid through outlet 24 to hose 28. Further, if tanks 36 and 38 were a larger capacity, a greater volume of fluid could be delivered by pump 14' to spray gun 18 through hose 28. When the spray gun operator wants to switch to the fluid in tank 38 he would simply close valves 46 and 56 and open valves 48 and 58. Fluid from tank 36 would then be recirculated through bypass pipe 52 back to tank 36 while fluid from tank 38 is delivered through conduit 30 to the valve block 54 and spray gun 58.

As a further alternative, spray gun 18 is connected to valve block 54 through a quick disconnect 60 shown separated in FIG. 3. The connector is operated by simply pulling back on sleeve 62 to separate the valve block from bib 64 attached to the spray gun 18. Thus, the system is very versatile and can be easily changed to new fluid components of any viscosity or color by exchanging tanks 36, 38 and connecting a new spray gun 18.

Thus, there has been disclosed and described a dual component pumping system permitting selection of one of two components for delivery to a spray gun. The spray gun can be used to spray fluid supplied by one of a pair of alternately reciprocating pumps delivering fluid from one tank while fluid is being recirculated to a second tank. Additionally, the two pumps can be of different capacity for pumping different viscosity fluids or to pump a larger supply of fluid of one type.

This invention is not to be limited by the embodiment shown in the drawings and described in the description, which is given by way of example and not of limitation, but only in accordance with the scope of the appended claims.

What is claimed is:

1. A dual fluid component supply system comprising;

a pair of alternating reciprocal pumps;

a double-acting reciprocal air motor connected by a common shaft to each of said pumps to alternately drive said reciprocal pumps;

a pair of separate fluid supply means connected to a separate inlet to each of said pair of reciprocal pumps for delivering a fluid to each of said pumps;

discharge means connected to respective outlets from each of said reciprocal pumps for delivering fluids from said reciprocal pumps;

switch means for selectively switching said discharge means alternately from one of said pump outlets to the other;

said switch means adapted to switch the other of said pumps into a bypass made so that fluid from said supply means continuously circulates from said supply means through said other pump back to said supply means while said one of said pumps is delivering fluid to said discharge means;

whereby fluid is continuously supplied to said discharge means from one of said pumps while the other of said pumps continuously circulates fluid in a bypass mode to keep said fluid in said supply means ready for use.

2. The system according to claim 1 in which said switching means comprises: valve means at the outlet of each pump; bypass means for bypassing fluid from each pump tank to said fluid supply means; said bypass means being connected to valve means; said valve means on each pump being constructed to switch fluid from said fluid supply means to said respective pump outlet whereby when one pump is delivering fluid the other pump is recirculating fluid through said bypass means back to said supply means.

3. The system according to claim 1 including a spray gun; connecting means connecting the outlets of said pair of pumps whereby one or the other of said fluids can be selectively sprayed.

4. The system according to claim 3 in which said connecting means comprises a valve block having a pair of valves connecting two inlets to a single outlet; said single outlet being connected to said spray gun; hose means connecting said two inlets to the respective outlets of said pumps.

5. The system according to claim 4 including quick disconnect means connecting said single outlet to said spray gun whereby said spray gun may be easily changed.

6. The system according to claim 2 in which said fluid supply means comprise a pair of open canisters; each of said pumps having an intake tube connected to each respective pump inlet; said intake tubes arranged to draw fluid into said respective pumps when their ends are submerged in fluid in said canisters.

7. The system according to claim 1 in which said pair of reciprocal pumps are unequal in capacity whereby one of said pumps can deliver a greater value of fluid than the other of said pumps.

8. The system according to claim 2 in which said pair of reciprocal pumps are unequal in capacity whereby one of said pumps can deliver a greater value of fluid than the other of said pumps.

* * * * *